US006098833A

United States Patent [19]

von Holdt, Sr., deceased et al.

[11] Patent Number: 6,098,833

[45] Date of Patent: *Aug. 8, 2000

[54] PLASTIC BUCKET AND LID

[76] Inventors: John W. von Holdt, Sr., *deceased, late of* Niles, Ill.; by John W. von Holdt, Jr., *executor*, 3121 Mary Kay La., Glenview, Ill. 60025

[ * ] Notice: This patent is subject to a terminal disclaimer.

[21] Appl. No.: 09/106,485

[22] Filed: Jun. 29, 1998

Related U.S. Application Data

[63] Continuation of application No. 08/823,193, Mar. 24, 1997, Pat. No. 5,913,446, which is a continuation-in-part of application No. 08/798,511, Feb. 10, 1997, abandoned, which is a continuation-in-part of application No. 08/707,746, Sep. 4, 1996, abandoned, which is a continuation-in-part of application No. 08/262,916, Jun. 21, 1994, abandoned.

[51] Int. Cl.[7] ..... B65D 1/42

[52] U.S. Cl. ..... 220/659

[58] Field of Search ..... 220/780, 782, 220/659, 658, 657, 656, 672, 670, 675

[56] References Cited

U.S. PATENT DOCUMENTS 5,913,446 6/1999 Holdt, Sr. et al. ..... 220/659

*Primary Examiner*—Stephen Castellano
*Attorney, Agent, or Firm*—Banner & Witcoff, Ltd.

[57] ABSTRACT

A plastic bucket includes at least one undercut adjacent an upper end of the bucket defined by a bucket wall which extends upwardly and inwardly along a diagonal path. An annular, vertical section may be provided at the upper end of the diagonal path. Above the vertical section, the bucket wall extends radially outwardly to create an annular, horizontal flange. In addition, an uppermost annular rim may extend upwardly from the horizontal flange and be located approximately midway between inner and outer radii of the flange.

6 Claims, 6 Drawing Sheets

14
20
18
36
12
16
30
28
22
34
32
34
32
34
38
10
39

12
2
16
22
32
2
10

46
10a
39a
46

28
24
26
12
22
16
34
32
34
10
34

16a
14a
20a
12a
30a
18a
28a
22a
44
42
40
48
46
39a
10a

FIG. 14
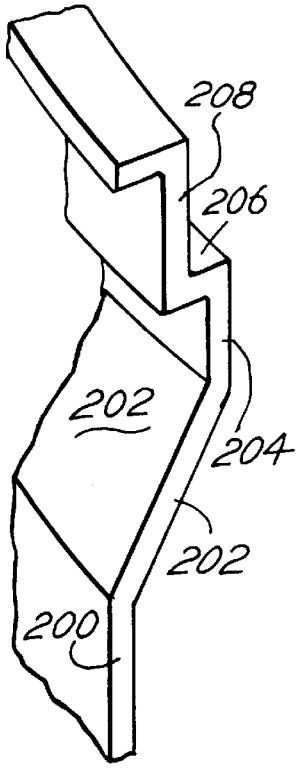
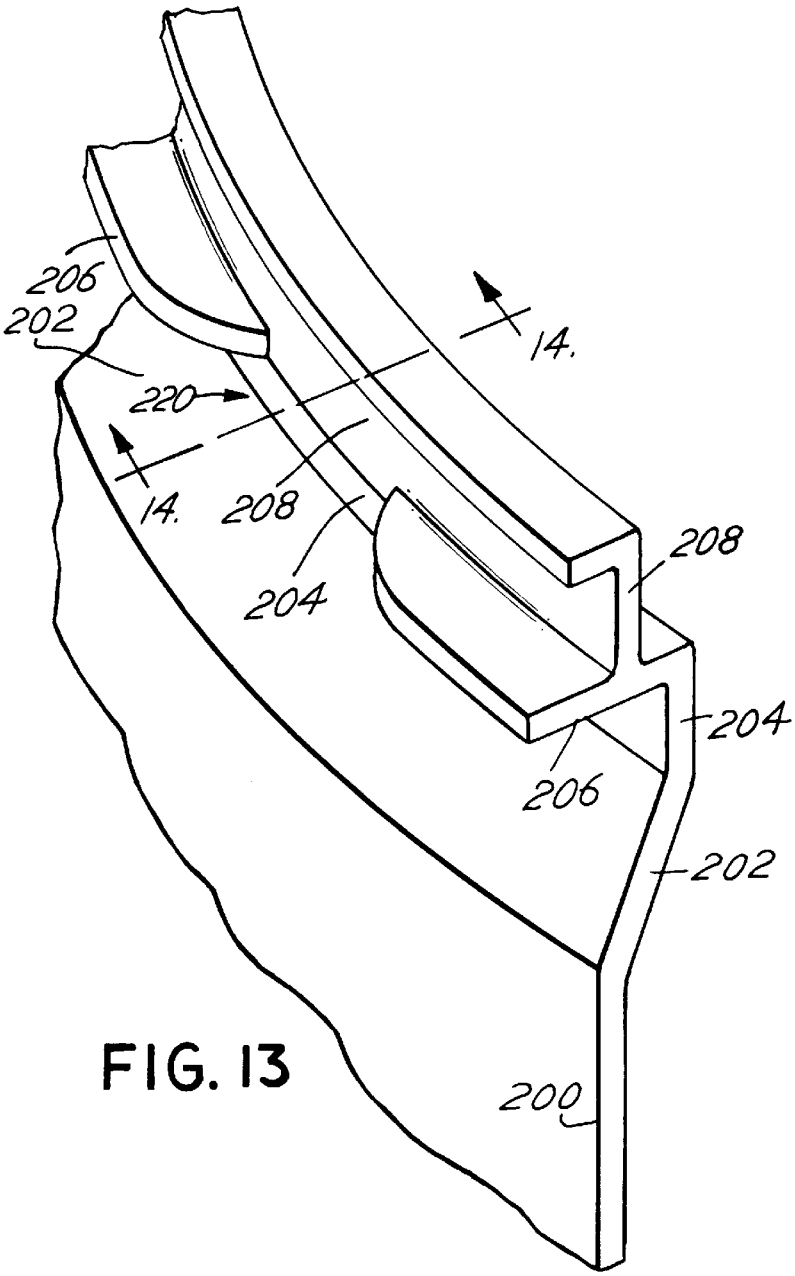
FIG. 13

PLASTIC BUCKET AND LID

CROSS REFERENCE TO RELATED APPLICATIONS

This is a continuation of U.S. Ser. No. 08/823,193, filed Mar. 24, 1997, now U.S. Pat. No. 5,913,446, which is a continuation-in-part of application U.S. Ser. No. 08/798,511 filed Feb. 10, 1997, now abandoned, which is a continuation-in-part of application U.S., Ser. No. 08/707, 746, filed Sep. 4, 1996, now abandoned, which is a continuation-in-part of U.S. Ser. No. 08/262,916, filed Jun. 21, 1994, now abandoned.

BACKGROUND OF THE INVENTION

Many designs of plastic buckets and lids are well-known, see for example the following patents of John W. Von Holdt: U.S. Pat. Nos. 4,375,948; 4,574,974; 4,512,494; 4,512,493; 4,452,382; 4,380,305; 4,308,970; and 4,210,258.

Many containers, such as cans for food, paint and other solvents and chemicals have also been made of plastic, as shown in the above-cited patents. However, plastic buckets of course lack the strength of metal buckets, so that in many cases special designs of the plastic buckets must be used to obtain, for example, a desired level of hoop strength about the mouth of the plastic bucket. This hoop strength is achievable in the prior art by reinforcement in some manner of the mouth area of the plastic bucket, typically involving an annular portion that projects radially inwardly, which reinforces the bucket.

However, buckets of this design typically require a collapsible core for their molding, which adds capital and operating expense to the operation, and also tends to slow the operation down. Likewise, collapsible cores are subject to failure and other problems, which further slows the efficiency of the operation.

In accordance with this invention, a plastic bucket is provided which does not require manufacture by the use of a collapsible core. At the same time, the bucket has a desired amount of hoop strength, even a plastic bucket which is of the shape of a conventional metal paint can.

DESCRIPTION OF THE INVENTION

By this invention, a plastic bucket defines an annular lip and an attachable plastic lid. The lid defines a peripheral, outer annular wall which defines an outer wall of an annular recess of the lid. The bucket lip occupies the recess in locked, sealed relation with the lid.

A principal object of the present invention is to provide a unique design for the upper end of a plastic container comprising an annular undercut section, an annular vertical wall portion above the undercut section, an annular horizontal ledge above the annular vertical wall, and an upright annular rim at the uppermost end of the bucket which rim is positioned approximately centrally with respect to the annular horizontal ledge.

In a preferred embodiment, the foregoing bucket is provided with only a single undercut section which facilitates its molding and permits it to be molded without use of a collapsible mold core, preferably by using a mold of the type described in my U.S. Pat. No. 4,375,948.

The foregoing novel bucket design has been proven by extensive testing to afford surprisingly improved hoop strength and stacking strength. Such improved strength characteristics are so significant that it is possible with such a bucket design to eliminate all external ribs or rings which are commonly used to provide hoop strength such as shown in Holt U.S. Pat. No. 3,977,563 and Letica U.S. Pat. No. 4,349,119. The eliminating of all such external ribs and or rings, as well as the elimination of any internal ribs, provides an exceptionally clean and simple design which is easy to mold and offers numerous advantages to the users of such plastic buckets.

The present invention is not limited to the use of a single undercut, but for most applications that is the preferred embodiment. It is definitely preferred to mold the foregoing bucket without use of a collapsible mold core, and my preferred mold is of the type shown in my U.S. Pat. No. 4,375,948, but other molds may possibly be used in certain applications.

The invention is also not limited to a design which has no external or internal ribs, but my preferred embodiment has no external ribs and preferably has no internal ribs because my unique bucket design provides the desired hoop strength and stacking strength without the need for the increased strength which such ribs commonly provide. Nevertheless, certain alternative embodiments which employ external or internal ribs will be described herein.

DESCRIPTION OF THE DRAWINGS

Referring to the drawings,

FIG. 13 is a fragmentary perspective view showing an interruption or slot formed in the radially outer portion of the horizontal flange formed beneath the uppermost rim of the bucket; and FIG. 14 is a fragmentary vertical section taken along the line A—A of FIG. 13.

Now, in order to acquaint those skilled in the art with the manner of making and using my invention, I shall describe, in conjunction with the accompanying drawings, certain preferred embodiments of the present invention.

DESCRIPTION OF PREFERRED EMBODIMENTS

Figures 1, 2, 3, 4, 5:
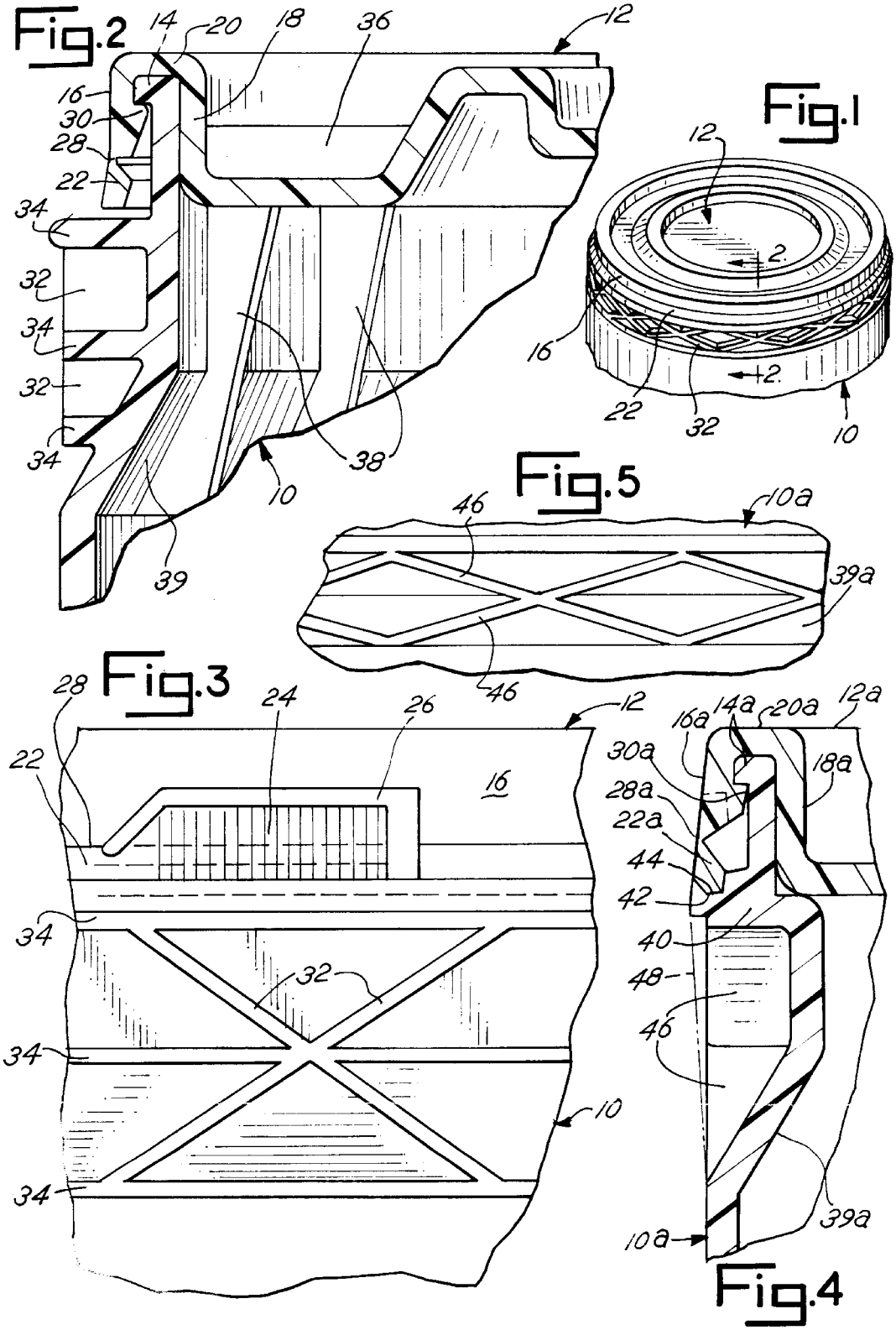
FIG. 1 is a perspective view of a molded bucket and attached lid in accordance with this invention.
FIG. 2 is an enlarged, fragmentary, transverse sectional view through the bucket lip and the periphery of the lid of the bucket, taken along line 2—2 of FIG. 1.
FIG. 3 is an enlarged, fragmentary, elevational view of the lid and upper portion of the bucket of FIG. 1, showing a portion of a tear strip.
FIG. 4 is a fragmentary, enlarged, longitudinal sectional view of another embodiment of a bucket and lid.
FIG. 5 is a fragmentary, enlarged, elevational view of a portion of the bucket of FIG. 4.

Referring to FIGS. 1–3, a plastic bucket 10 having an attached lid 12 is shown, each of the lid and bucket being manufactured by injection molding from known plastic compositions.

Bucket 10 is shown to comprise an annular lip 14 which defines the bucket mouth across which lid 12 extends. Lid 12, in turn, defines a peripheral, outer annular wall 16 which, with annular, inner lid wall 18 and annular bridging wall 20, defines an annular recess which is occupied by bucket lip 14 in locked, sealed relation with lid 12.

Outer, annular lid wall 16 also defines a circumferential tear strip 22, which extends almost completely about the circumference of lid wall 16 or being continuous about that wall, terminating at one end with a free handle 24 which is partly surrounded by a space 26, so that handle 24 may be grasped and pulled to cause circumferential tearing of the circumferential tear line 28. Upon removal of tear strip 22, the remainder of outer wall 16 may be pried outwardly with relative ease for opening of the lid.

Inwardly extending projections 30 are provided in known manner, being intermittently spaced about the periphery of lid wall 16 or being continuous about that wall to engage the undersurface of bucket lip 14, as shown in FIG. 2.

Thus, after removal of tear strip 22, the bucket lid is readily opened and reclosed as desired.

Additionally, bucket 10 defines a plurality of outwardly and diagonally extending ribs 32, which are an integrally molded part of the bucket 10 and which intersect each other in criss-cross relation. These ribs are positioned entirely around the periphery of bucket 10, and serve to increase the hoop strength of the bucket.

Also, bucket 10 is shown to define three outwardly extending, integral rings 34 which intersect the diagonal ribs 32, and thus also contribute to improving the bucket's hoop strength in the vicinity of the bucket lip.

Thus, buckets 10 can be molded which, although made of plastic, can have hoop strength that is comparable with metal buckets, yet which are better than metal buckets in their resistance to pop off of the lid, when the bucket is dropped and the like. Appropriate fins or vanes 36 may be provided to strengthen lid 12 as may be desired. Also, internal fins or vanes 38 may be provided to bucket 10 for a similar strengthening purpose.

Also, it can be seen that bucket 10 defines only one annular, diagonal undercut 39, so that rings 34 may be provided without exceeding the main diameter of the bucket. This permits the use of such a bucket in conventional filling machinery and the like. Also, such a bucket, in which the inward extent of the undercut 39 is no more than about one-quarter inch, or not over 6% of the bucket diameter can be manufactured with a mold core which is not collapsible, such as the mold shown in U.S. Pat. No. 4,375,948. The bucket of preferred designs as shown can be popped off of the mold core.

Referring to FIGS. 4 and 5, a molded bucket 10*a* carries a lid 12*a* which is of generally similar design to the previous embodiment except as otherwise shown herein.

As before, lid 12*a* defines an outer annular wall 16*a* which, in conjunction with inner annular wall 18*a* and annular bridging wall 20*a*, defines an annular recess for the securance of bucket lip 14*a*.

In this particular embodiment, bucket lip 14*a* is carried upon a flange 40 which extends outwardly and is carried by the bucket. Flange 40 defines an annular recess 42 in which the lower edge 44 of outer, annular lid wall 16*a* is "buried", to prevent one who desires to open the container from prying the lid 12*a* off of the bucket with a screw driver or the like. Thus, lid 12*a* is permanently attached to bucket 10*a* until the removal of tear strip 22*a* is accomplished.

Tear strip 22*a* may be of similar design to tear strip 22 of the previous embodiment. When it has been circumferentially removed by tearing along tear line 28*a* in similar manner, the remaining portion of outer, annular wall 16*a* is easily removed either with the fingers or a screw driver. Inwardly extending projection 30*a* may be continuous and annular, or it may be intermittent along the circumference for easier opening of lid 12*a*.

A single undercut 39*a* is provided in bucket 12*a* also, similar to the previous embodiment. This provides a recess in which diagonal vanes or ribs 46 may be provided, extending in a diagonal, criss-cross manner as illustrated by FIG. 5. This provides significantly increased hoop strength to bucket 12*a*. Also, a label 48 may be placed over the criss-cross ribs 46 if desired by automatic label applying machinery.

The resulting container is tamper proof because of the required use of tear strip 22*a* to open it, and exhibits a high hoop strength for avoiding inadvertent lid pop off when the container is dropped or the like.

Figure 6:
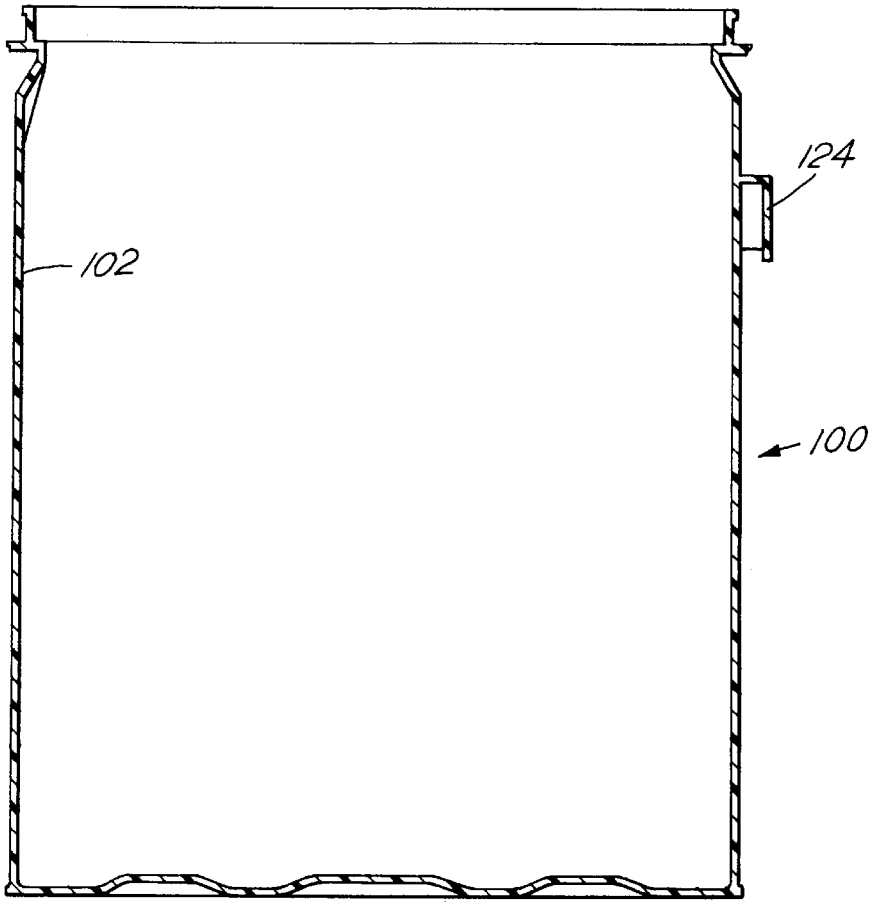
FIG. 6 is a vertical sectional view taken along the line 6—6 of FIG. 8 showing an alternative embodiment of the invention where a single undercut is provided at the upper end of the container and a plurality of internal reinforcing ribs are formed in the area of the undercut but no external ribs are provided as in the earlier embodiments.
Figure 7:
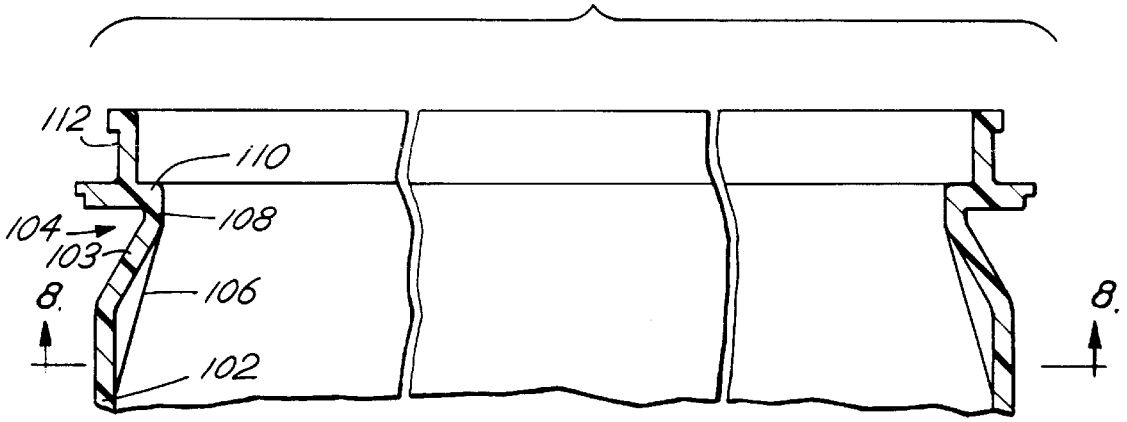
FIG. 7 is an enlarged fragmentary view showing the upper end of the container of FIG. 6.
Figure 8:
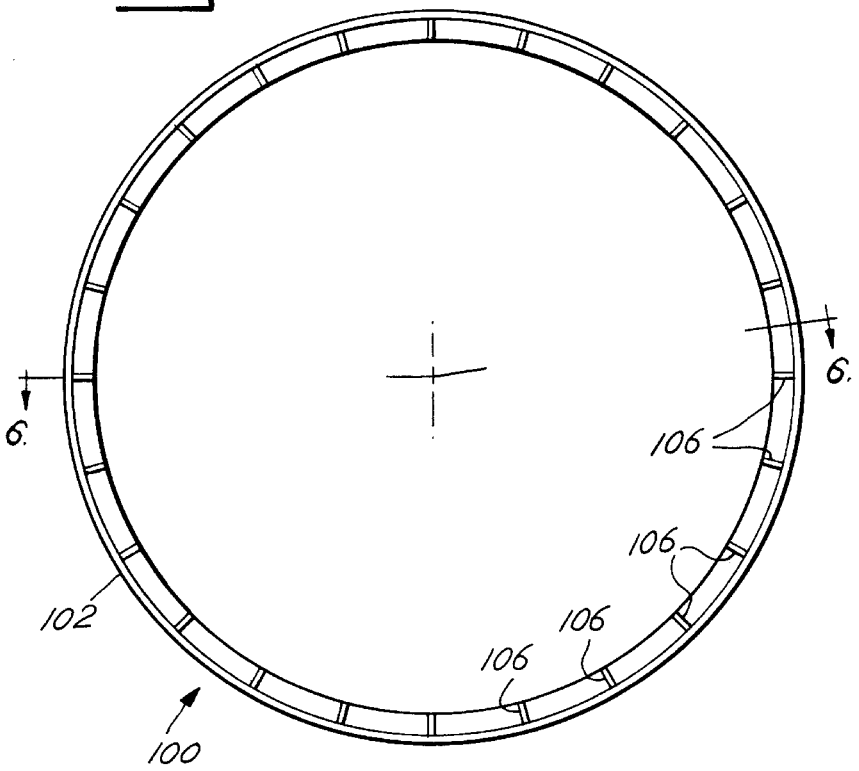
FIG. 8 is a view looking upwardly along the line 8—8 of FIG. 7 showing a plurality of internal ribs spaced around the interior wall of the container near the upper end thereof.

Reference is now made to the embodiment of FIGS. 6–8 where a bucket or container 100 has a container wall 102 which slopes inwardly at its upper end as best shown at 103 in FIG. 7 to provide a single undercut area shown at 104. In this embodiment, no external ribs are formed in the undercut area 104, but internal ribs are provided as shown at 106. FIG. 8 shows the internal ribs 106 as being generally radial and spaced around the entire inside circumference of the upper end of the bucket or container.

The upper end of the container 100 differs from the container shown in FIG. 2 because it has an offset in the container wall above the single undercut, generally as shown in FIG. 4. Thus, referring to FIG. 7, the container wall 102 slopes inwardly at 103 to form the offset 104 and then extends upwardly again at 108 and then outwardly to form an offset 110. Finally, the container wall extends upwardly again at 112 to define the open mouth of the container. The offset 110 provides an advantage in that it affords increased hoop strength for the upper end of the container.

Figure 9:
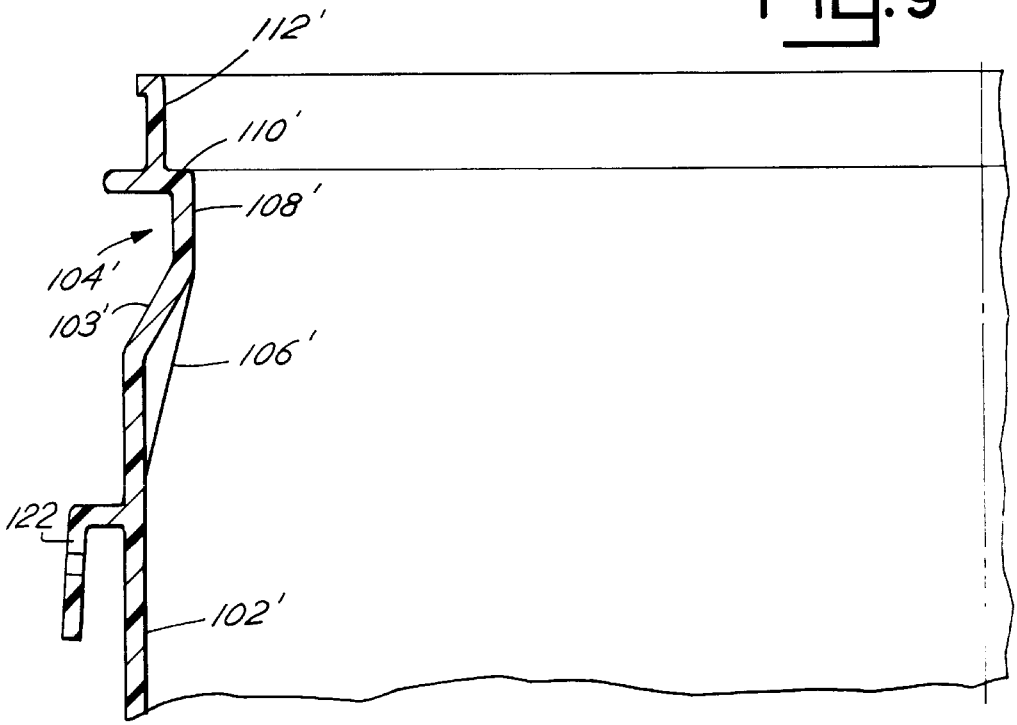
FIG. 9 is a fragmentary vertical section showing another alternative embodiment of the invention having a single undercut at the upper end and having an offset at the upper end of the undercut as shown in the embodiment of FIG. 4, there being provided internal ribs in the area of the undercut as in the embodiment of FIGS. 6–8 without the use of any external ribs in the undercut area, and there being shown one of two bale ears for holding a molded handle.

In order to facilitate the molding of a plastic bucket in accordance with the present invention, and avoid the need for a collapsible mold core, it is necessary to limit the magnitude of the undercut such as shown, for example, at 104 in FIG. 7 or at 104' in FIG. 9, i.e., the amount that the wall shown at 108 in FIG. 7 is radially offset from the wall shown at 102. The deeper the offset, the more difficult it is to mold a bucket without use of a collapsible mold core.

Generally speaking, the magnitude of the undercut should not exceed approximately 5% or 6% of the diameter of the container. For example, with a larger container having a diameter of 12 inches, it is preferable that the undercut not extend inwardly more than about ¾ inch. However, for a smaller container, the undercut may comprise a larger percentage of the diameter. For example, with a container having a 2 inch diameter, it is preferable that the undercut not extend inwardly more than ⅜ inch.

For most containers, it is preferred that the undercut not exceed ⅜ of an inch, but for containers of larger size, such as 12 inch diameter, the undercut may extend inwardly as much as ¾ inch. The critically important advantage of the use of an undercut in the present invention is that by using only a single undercut, and controlling the magnitude of the undercut, it is possible to mold the container without use of a collapsible mold core.

Reference is now made to FIG. 9 which shows an embodiment similar to the embodiment of FIGS. 6–8 with corresponding components identified with corresponding primed numerals. In FIG. 9, the container wall 102' slopes inwardly at 103' and then upwardly at 108', and it then extends outwardly again at 110' to form an offset for added hoop strength as in the prior embodiment. The single undercut 104' has no external ribs, but internal ribs are provided at 106' as in the embodiment of FIGS. 6–8. The vertical wall portion 108' is somewhat longer than in the embodiment of FIGS. 6–8. In addition, FIG. 9 shows one of two opposed bale ears 122 which serve for mounting a handle as will be described below. A similar bale ear is shown at 124 in FIG. 6, the opposite one not being shown in FIG. 6 due to the section line 6—6 in FIG. 8.

Figure 10:
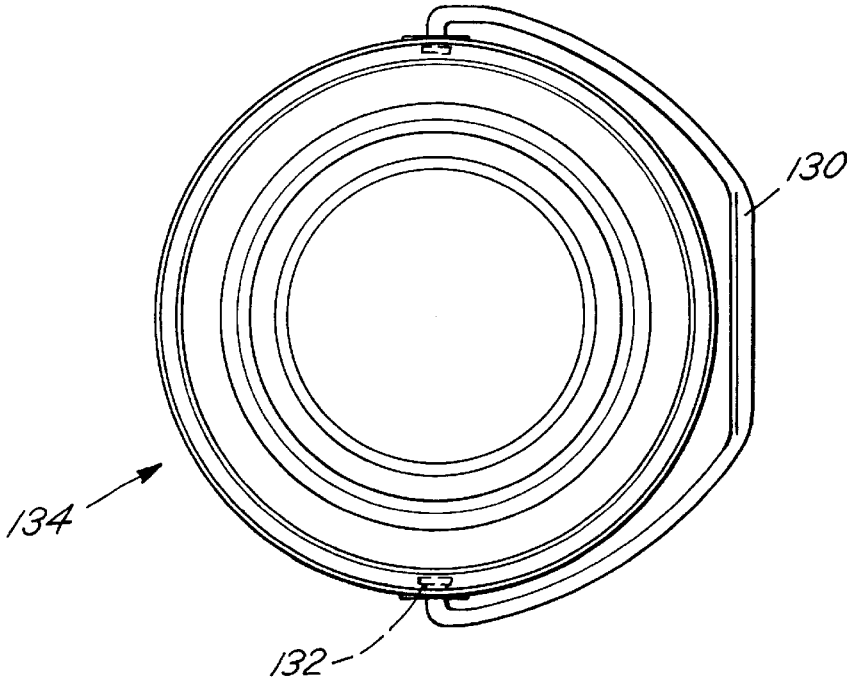
FIGS. 10 and 11 are top and side elevational views of a bucket of the type generally described herein but showing the addition of a plastic handle which is molded during the molding operation to mold the bucket.
Figure 11:
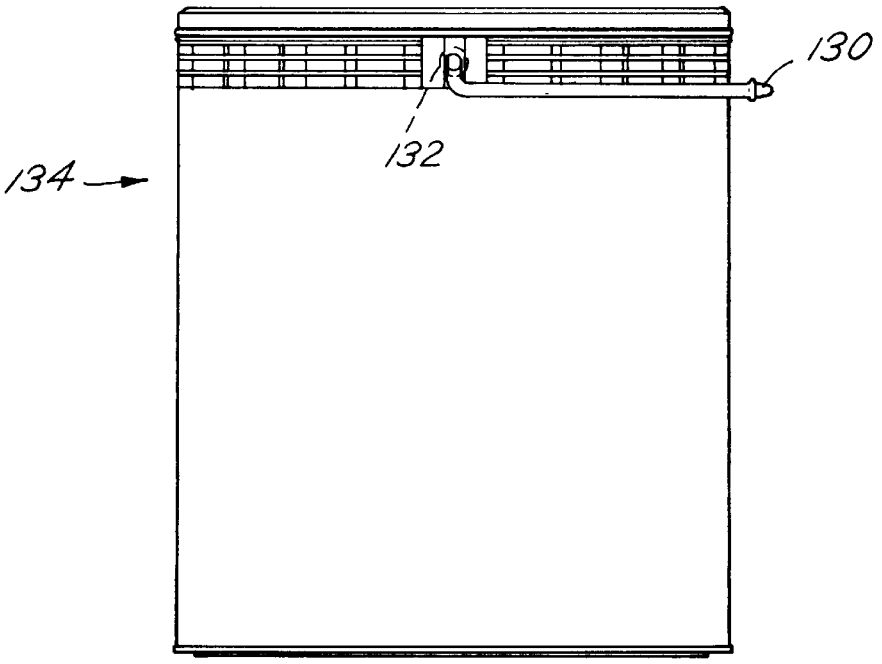

FIGS. 10 and 11 show a further embodiment of a container including a handle 130 which is pivotally connected to opposite sides of the bucket as shown at 132 The bucket shown at 134 is similar to the external rib embodiments described earlier herein, the principal difference being the addition of the handle 130 which can be molded during the molding of the bucket.

Reference is again made to the embodiment of FIGS. 1–3, and the embodiment of FIGS. 4–5. It should be understood that while the radially inwardly projecting ribs 38 are shown only in FIG. 2 which is part of the embodiment of FIGS. 1–3, the description of the embodiment of FIGS. 4–5 indicates that the same features of the embodiment of FIGS. 1–3 are included except as otherwise described, so the intent is that the embodiment of FIGS. 4–5 may include the internal radially inwardly projecting ribs shown at 38 in FIG. 2.

Figure 12:
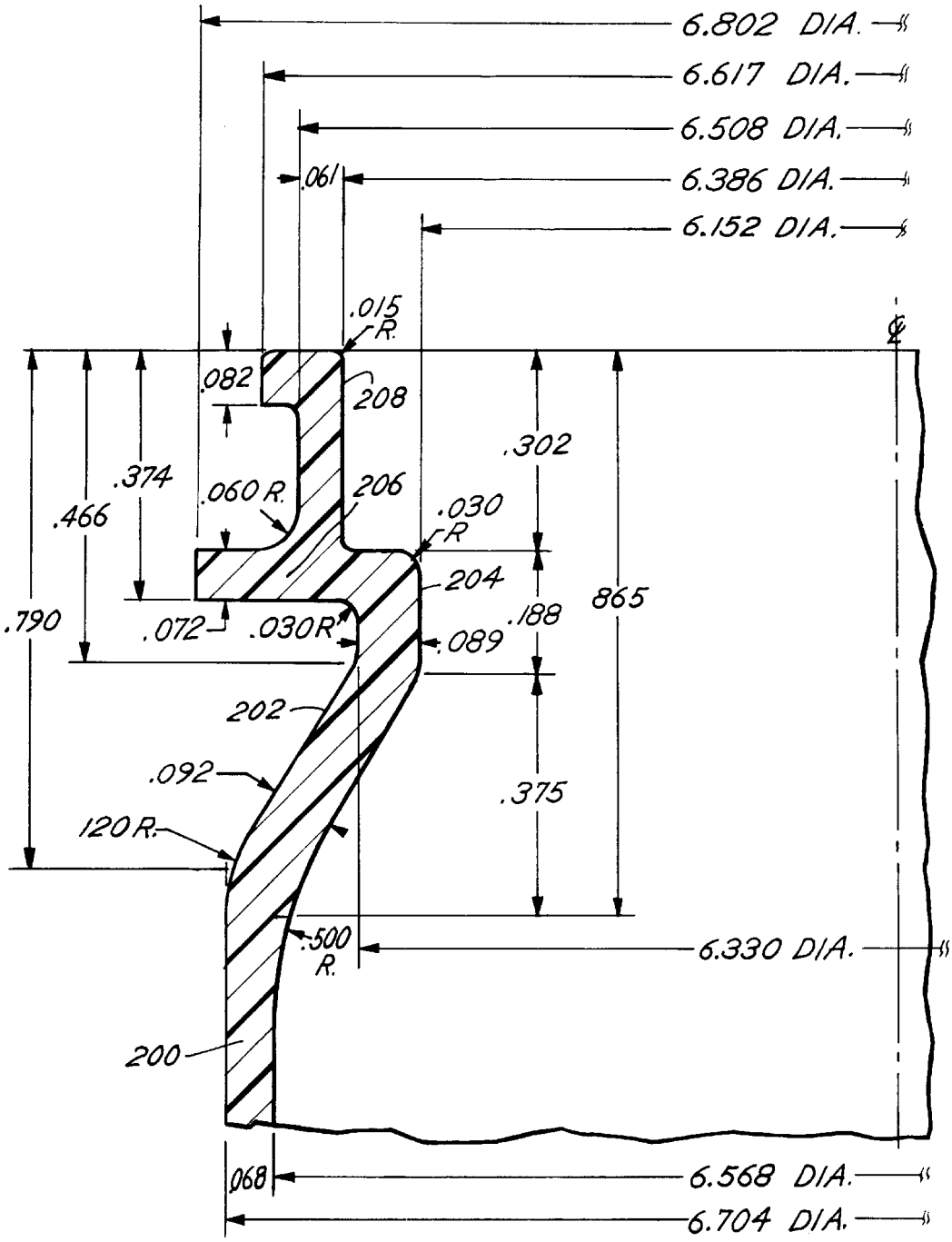
FIG. 12 is a fragmentary vertical section showing a preferred embodiment of the present invention which is similar to the embodiment of FIG. 4 and also to the embodiment of FIG. 9 but it has no external or internal ribs because the bucket design affords the necessary strength without such ribs.

Reference is now made to FIG. 12, which shows a preferred embodiment of the present invention. In FIG. 12, the upright container wall 200 slopes inwardly at 202 and then upwardly at 204, and it then extends outwardly again at 206 to form a horizontal, annular flange which together with vertical section 204 affords very substantial hoop strength and stacking strength. An uppermost annular, vertical rim 208, designed to cooperate with a lid (not shown) as generally shown in FIG. 2, extends up from horizontal, annular ledge 206 from a radius which is approximately midway between the inner and outer radii of the horizontal ledge 206.

FIG. 12 shows the uppermost, annular rim 208 being positioned approximately midway between the inner and outer radii of the horizontal, annular flange 206. The foregoing approximate location of rim 208 relative to horizontal flange 206 is desirable in many applications. However, there is a further consideration which is that for optimum strength characteristics it has been found desirable to locate the uppermost rim 208 so that the radially inner wall of rim 208 is not radially inwardly of the radially outer wall of vertical section 204. As shown in FIG. 12, the radially inner wall of uppermost rim 208 is slightly radially outwardly of the radially outer wall of vertical section 204, which has proved to be a desirable relative position for uppermost rim 208. Thus, while the rim 208 may be located radially inwardly from the position shown in FIG. 12, it preferably should not be located so its radially inside wall is radially inwardly of the outside of upright wall 204.

There are no outer ribs located in the section defined by the undercut 202, as for example, in the embodiment of FIG. 2. Also, there are no internal ribs radially inwardly of the undercut wall 202 as in the embodiment of FIG. 2 or the embodiment of FIG. 9. The preferred design shown in FIG. 12 is free of external and internal ribs. As explained previously, the design of the bucket comprising undercut 202, vertical section 204, horizontal flange 206 and upper, vertical rim 208 provides unexpected strength sufficient so that additional strength which the ribs afford is not needed.

While the present invention is not limited to a bucket having no external or internal ribs, the design shown in FIG. 12 which has no ribs is the preferred embodiment because it affords a clean and simple design which is easy to mold and which is extremely advantageous for certain applications such as for a one-gallon plastic paint can. The preferred embodiment shown in FIG. 12 has only a single undercut, which makes the bucket easier to mold without using a collapsible mold core, but the present invention may also be used with a bucket which has more than one undercut.

It is highly desirable that the angle of the undercut wall 202, i.e., the angle the wall defines with the vertical, be controlled so as not to exceed 45 degrees. If the foregoing angle exceeds approximately 45 degrees, it may not be possible to mold the bucket without using a collapsible mold core, especially if more than one undercut is used as in Letica U.S. Pat. No. 4,349,119. The angle for the wall 202 is approximately 30 degrees, as shown in FIG. 12, and a preferred range for such angle is between approximately 30 degrees and 45 degrees. However, satisfactory results may be obtained using an angle in the range of 20 degrees to 50 degrees.

I prefer a range of 30 degrees to 45 degrees for the angle which diagonal wall 202 defines with a vertical. A smaller angle can have disadvantages because if you wish to maintain the depth of the undercut, a smaller angle means that the vertical height component of the diagonal wall 202 will be greater, and in that case the upright bucket wall 200 will have less height. Since the upright wall 200 is often used for carrying a label, it may be a disadvantage in some applications to reduce its height significantly from what is shown in FIG. 12.

The general purpose of the undercut is to produce hoop strength, and the vertical section 204 combined with the horizontal flange 206 affords exceptional hoop strength to a degree which permits elimination of external and internal ribs. As a result, if one were to reduce the angle which diagonal wall 202 makes with a vertical, one would in most cases not want to significantly reduce the depth of the undercut shown in FIG. 12, and because in many applications it is not desirable to substantially increase the vertical height component of the diagonal wall 202, it is preferred in such applications to avoid reducing the angle between diagonal wall 202 and a vertical to much less than 30 degrees.

The combination of the undercut 202, upright or vertical, annular section 204, horizontal, annular ledge 206, and uppermost, annular rim 208 located approximately midway between the inner and outer radii of ledge 206, affords surprisingly increased hoop strength and stacking strength. FIG. 12 has the actual dimensions of the bucket wall shown in inches. The dimensions shown are for a one-gallon plastic bucket and will change for larger and smaller buckets. While the invention is clearly not limited to particular dimensions, the relative positioning and relative dimensions of the structural components 202, 204, 206 and 208 are important, and the particular design shown in FIG. 12 is considered a particularly advantageous arrangement.

While no lid is shown in conjunction with the preferred embodiment of FIG. 12, a lid of the general type including a tear strip as shown in FIG. 4 may be used, although it is not necessary that the lower edge of the lid wall be buried in the manner shown in FIG. 4.

FIGS. 13 and 14 show an interruption or slot formed at 220 in the radially outer portion of annular, horizontal flange 206. While such slot 220 will create a small amount of weakness, it serves the purpose of providing room for someone to insert their fingers beneath the outer wall of a lid for the purpose of removing the lid. Accordingly, for many applications the minor reduction in strength caused by the slot at 220 in the horizontal flange 206 is acceptable in order to facilitate manual removal of a lid.

Another feature shown in FIG. 12 concerns the thickness of the diagonal wall 202 and the vertical wall 204 compared to the outermost bucket wall 200. As shown in FIG. 12, both the diagonal wall 202 and the upright wall 204 are somewhat thicker than the main bucket wall 200. The reason for increasing the wall thickness of walls 202 and 204 is because the offset created by diagonal wall 202, while designed to increase hoop strength, will reduce stacking strength. As a result, when such an offset is used to create a substantial undercut, it is preferable that the wall 202, and in some cases also the wall 204, be made of increased thickness compared to main bucket wall 200 for the purpose of maintaining stacking strength. In the foregoing manner, excellent hoop strength and stacking strength may be obtained.

There are prior art patents which teach designs for plastic buckets and which provide various structure for the purpose of affording hoop strength and stacking strength. However, such prior art patents do not teach the present invention and fall far short of providing the advantages of the present invention, especially with respect to the preferred embodiment shown in FIG. 12.

Letica U.S. Pat. No. 4,349,119 in FIG. 5 shows a bucket design having a double undercut, one undercut being shown at 75 and a second undercut being shown at 106. The second undercut shown at 106 makes molding more difficult, especially since the angle from the vertical appears to exceed 45 degrees, and the Letica structure is made commercially from a collapsible mold core.

In addition, Letica shows a plurality of external rings or ribs 68, and generally the upper end of the Letica bucket differs markedly from the present invention, as can readily be seen by comparing FIG. 5 of Letica with FIG. 12 of the present invention.

Buc U.S. Pat. No. 4,524,882 shows a bucket design in FIG. 4 having a single undercut at 15 and a so-called bridge member 18 which presumably provides hoop strength. However, the Buc design fails to include any structure resembling the upright or vertical, annular section shown at 204 in FIG. 12 of the present invention which is located intermediate the undercut wall 202 and the horizontal, annular ledge 206, and which contributes in a major way to the hoop strength and stacking strength of the design shown in FIG. 12. In FIG. 12, the combination of sections 204 and 206 provides an annular L-shaped structure which offers unexpected advantages with respect to hoop strength.

In addition, the extreme upper end of the Buc bucket is quite different from the FIG. 12 design since it provides upright rim portions at the radially inner and outer edges of member 18 as opposed to the FIG. 12 design where a single annular rim 208 is approximately midway between the radially inner and outer portions of horizontal, annular ledge 206. Also, the Buc patent is merely a paper patent, and the design shown therein has never been used commercially.

One further prior art patent is Holt U.S. Pat. No. 3,997,563. FIG. 1 of Holt appears to show an undercut, although that structure is not shown in the other drawings. The upper end of the Holt bucket is entirely different from the design shown in FIG. 12 of the present invention and it comprises in essence an upright annular wall 10 with two annular rings or ribs 18 on the outside, and an uppermost rim which extends up from the radially inner edge of the ring 18. There is little if any similarity between the Holt design and the FIG. 12 design of the present invention.

What is claimed is:

1. A plastic bucket including an upright, annular bucket wall terminating in an annular lip to form an open bucket mouth, said bucket wall having an annular undercut located adjacent an upper end of said bucket, said bucket wall at said undercut extending upwardly and radially inwardly along a diagonal path, and said wall of said undercut being made thicker than the thickness of a wall of said bucket beneath said undercut.

2. A plastic bucket as defined in claim 1 where said bucket wall along said diagonal path has an upper end, and further including said bucket wall extending generally vertically upwardly at said upper end of said diagonal path to form an upright, annular section.

3. A plastic bucket as defined in claim 1 where said bucket wall along said diagonal path has an upper end, and further including said bucket wall extending radially outwardly from above said upper end of said diagonal path to form an annular, horizontal flange.

4. A plastic bucket as defined in claim 3 further comprising an upright, annular rim extending upwardly from a top of said annular, horizontal flange, said rim being located approximately midway between the inner and outer radii of said flange.

5. A plastic bucket as defined in claims 1, 2, 3 or 4 where no external ribs or rings are formed on said bucket wall in the area of said undercut.

6. A plastic bucket including an upright annular bucket wall terminating in an annular lip to form an open bucket mouth, said bucket wall having an annular undercut portion located adjacent an upper end of said bucket with no external ribs formed on said bucket wall in the area of said undercut portion, said bucket wall at said undercut portion extending upwardly and radially inwardly along a diagonal path, the magnitude of said radially inward movement of said undercut portion being controlled to permit said bucket to be molded without the use of a collapsible mold core, said undercut portion of said bucket wall made thicker than the thickness of a wall of said bucket beneath said undercut portion, said bucket wall extending generally vertically upwardly at the upper end of said diagonal path to form an upright annular section, and said bucket wall extending radially outwardly at said upper end of said upright annular section to form an annular, horizontal flange.

* * * * *